US008702437B2

(12) United States Patent
Fullerton et al.

(10) Patent No.: US 8,702,437 B2
(45) Date of Patent: Apr. 22, 2014

(54) ELECTRICAL ADAPTER SYSTEM

(75) Inventors: Larry W. Fullerton, New Hope, AL (US); Mark D. Roberts, Huntsville, AL (US)

(73) Assignee: Correlated Magnetics Research, LLC, Huntsville, AL (US)

( * ) Notice: Subject to any disclaimer, the term of this patent is extended or adjusted under 35 U.S.C. 154(b) by 78 days.

(21) Appl. No.: 13/430,219

(22) Filed: Mar. 26, 2012

(65) Prior Publication Data

US 2012/0244732 A1 Sep. 27, 2012

Related U.S. Application Data

(60) Provisional application No. 61/465,801, filed on Mar. 24, 2011.

(51) Int. Cl.
*H01R 33/02* (2006.01)

(52) U.S. Cl.
USPC ..... 439/236

(58) Field of Classification Search
USPC ..... 439/236, 375, 39, 289; 70/276
See application file for complete search history.

(56) References Cited

U.S. PATENT DOCUMENTS

| | | | |
|---|---|---|---|
| 493,858 | A | 3/1893 | Edison |
| 687,292 | A | 11/1901 | Armstrong |
| 996,933 | A | 7/1911 | Lindquist |
| 1,171,351 | A | 2/1916 | Neuland |
| 1,236,234 | A | 8/1917 | Troje |
| 2,243,555 | A | 5/1941 | Faus |
| 2,389,298 | A | 11/1945 | Ellis |
| 2,438,231 | A | 3/1948 | Schultz |
| 2,471,634 | A | 5/1949 | Vennice |
| 2,570,625 | A | 10/1951 | Zimmerman et al. |
| 2,722,617 | A | 11/1955 | Cluwen et al. |
| 3,055,999 | A | 9/1962 | Lucas |
| 3,102,314 | A | 9/1963 | Alderfer |
| 3,208,296 | A | 9/1965 | Baermann |
| 3,238,399 | A | 3/1966 | Johanees et al. |
| 3,288,511 | A | 11/1966 | Tavano |
| 3,301,091 | A | 1/1967 | Reese |
| 3,382,386 | A | 5/1968 | Schlaeppi |
| 3,408,104 | A | 10/1968 | Raynes |

(Continued)

FOREIGN PATENT DOCUMENTS

| | | | |
|---|---|---|---|
| CN | 1615573 | A | 5/2005 |
| DE | 2938782 | A1 | 4/1981 |

(Continued)

OTHER PUBLICATIONS

Atallah, K., Calverley, S.D., D. Howe, 2004, "Design, analysis and realisation of a high-performance magnetic gear", IEE Proc.-Electr. Power Appl., vol. 151, No. 2, Mar. 2004.

(Continued)

*Primary Examiner* — Alexander Gilman
(74) *Attorney, Agent, or Firm* — Venable LLP; Robert S. Babayi

(57) ABSTRACT

An electrical adapter, the adapter including an Edison screw base configured to receive a primary voltage from a voltage source, a voltage converter circuit configured to convert the primary voltage to the secondary voltage, and a first electrical connector part configured to be detachably coupled to a second electrical connector part of an electrical fixture configured to be powered by the secondary voltage.

20 Claims, 8 Drawing Sheets

(56) References Cited

U.S. PATENT DOCUMENTS 2,932,545 A 4/1969 Foley
3,468,576 A 9/1969 Beyer et al.
3,474,366 A 10/1969 Barney
3,521,216 A * 7/1970 Tolegian ..... 439/39
3,645,650 A 2/1972 Laing
3,668,670 A 6/1972 Andersen
3,684,992 A 8/1972 Huguet et al.
3,696,258 A 10/1972 Anderson et al.
3,790,197 A 2/1974 Parker
3,791,309 A 2/1974 Baermann
3,802,034 A 4/1974 Bookless
3,803,433 A 4/1974 Ingenito
3,808,577 A * 4/1974 Mathauser ..... 439/39
3,845,430 A 10/1974 Petkewicz et al.
3,893,059 A 7/1975 Nowak
4,079,558 A 3/1978 Forham
4,117,431 A 9/1978 Eicher
4,129,846 A 12/1978 Yablochnikov
4,209,905 A 7/1980 Gillings
4,222,489 A * 9/1980 Hutter ..... 211/45
4,296,394 A 10/1981 Ragheb
4,352,960 A 10/1982 Dormer et al.
4,355,236 A 10/1982 Holsinger
4,399,595 A 8/1983 Yoon et al.
4,416,127 A * 11/1983 Gomez-Olea Naveda ..... 70/276
4,453,294 A 6/1984 Morita
4,535,278 A 8/1985 Asakawa
4,547,756 A 10/1985 Miller et al.
4,629,131 A 12/1986 Podell
4,645,283 A * 2/1987 MacDonald et al. ..... 439/236
4,680,494 A 7/1987 Grosjean
381,968 A 5/1988 Tesla
4,764,743 A 8/1988 Leupold et al.
4,837,539 A 6/1989 Baker
4,849,749 A 7/1989 Fukamachi et al.
4,862,128 A 8/1989 Leupold
H693 H 10/1989 Leupold
4,893,103 A 1/1990 Leupold
4,912,727 A 3/1990 Schubert
4,941,236 A 7/1990 Sherman et al.
4,956,625 A 9/1990 Cardone et al.
4,993,950 A 2/1991 Mensor, Jr.
4,994,778 A 2/1991 Leupold
4,996,457 A 2/1991 Hawsey et al.
5,013,949 A 5/1991 Mabe, Jr.
5,020,625 A 6/1991 Yamauchi et al.
5,050,276 A * 9/1991 Pemberton ..... 24/303
5,062,855 A 11/1991 Rincoe
5,123,843 A 6/1992 Van der Zel et al.
5,179,307 A 1/1993 Porter
5,213,307 A 5/1993 Perrillat-Amede
5,302,929 A 4/1994 Kovacs
5,309,680 A 5/1994 Kiel
5,345,207 A 9/1994 Gebele
5,367,891 A 11/1994 Furuyama
5,383,049 A 1/1995 Carr
5,838,304 A 1/1995 Car
5,394,132 A 2/1995 Poil
5,399,933 A 3/1995 Tsai
5,425,763 A 6/1995 Stemmann
5,440,997 A 8/1995 Crowley
5,461,386 A 10/1995 Knebelkamp
5,492,572 A 2/1996 Schroeder et al.
5,495,221 A 2/1996 Post
5,512,732 A 4/1996 Yagnik et al.
5,570,084 A 10/1996 Ritter et al.
5,582,522 A * 12/1996 Johnson ..... 439/214
5,604,960 A 2/1997 Good
5,631,093 A 5/1997 Perry et al.
5,631,618 A 5/1997 Trumper et al.
5,633,555 A 5/1997 Ackermann et al.
5,635,889 A 6/1997 Stelter
5,637,972 A 6/1997 Randall et al.
5,730,155 A 3/1998 Allen
5,759,054 A * 6/1998 Spadafore ..... 439/236
5,788,493 A 8/1998 Tanaka et al.
5,852,393 A 12/1998 Reznik et al.
5,935,155 A 8/1999 Humayun et al.
5,956,778 A 9/1999 Godoy
5,983,406 A 11/1999 Meyerrose
6,039,759 A 3/2000 Carpentier et al.
6,047,456 A 4/2000 Yao et al.
6,072,251 A 6/2000 Markle
6,074,420 A 6/2000 Eaton
6,115,849 A 9/2000 Meyerrose
6,118,271 A 9/2000 Ely et al.
6,120,283 A * 9/2000 Cousins ..... 431/289
6,142,779 A 11/2000 Siegel et al.
6,170,131 B1 1/2001 Shin
6,187,041 B1 2/2001 Garonzik
6,205,012 B1 3/2001 Lear
6,210,033 B1 4/2001 Karkos, Jr. et al.
6,224,374 B1 5/2001 Mayo
6,234,833 B1 * 5/2001 Tsai et al. ..... 439/541.5
6,273,918 B1 8/2001 Yuhasz et al.
6,275,778 B1 8/2001 Shimada et al.
6,285,097 B1 9/2001 Hazelton et al.
6,387,096 B1 5/2002 Hyde, Jr.
6,457,179 B1 10/2002 Prendergast
6,467,326 B1 10/2002 Garrigus
6,535,092 B1 3/2003 Hurley et al.
6,540,515 B1 4/2003 Tanaka
6,599,321 B2 7/2003 Hyde, Jr.
6,607,304 B1 8/2003 Lake et al.
6,652,278 B2 11/2003 Honkura et al.
6,653,919 B2 11/2003 Shih-Chung et al.
6,720,698 B2 4/2004 Galbraith
6,747,537 B1 6/2004 Mosteller
6,842,332 B1 1/2005 Rubenson et al.
6,847,134 B2 1/2005 Frissen et al.
6,850,139 B1 2/2005 Dettmann et al.
6,862,748 B2 3/2005 Prendergast
6,864,773 B2 3/2005 Perrin
6,913,471 B2 * 7/2005 Smith ..... 439/74
6,927,657 B1 8/2005 Wu
6,954,938 B2 10/2005 Emberty et al.
6,954,968 B1 10/2005 Sitbon
6,971,147 B2 12/2005 Halstead
7,016,492 B2 3/2006 Pan et al.
7,031,160 B2 4/2006 Tillotson
7,033,400 B2 4/2006 Currier
7,038,565 B1 5/2006 Chell
7,065,860 B2 6/2006 Aoki et al.
7,066,739 B2 * 6/2006 McLeish ..... 439/39
7,066,778 B2 6/2006 Kretzschmar
7,101,374 B2 9/2006 Hyde, Jr.
7,137,727 B2 * 11/2006 Joseph et al. ..... 362/648
7,148,440 B2 * 12/2006 Gjerde ..... 200/569
7,186,265 B2 3/2007 Sharkawy et al.
7,224,252 B2 5/2007 Meadow, Jr. et al.
7,264,479 B1 * 9/2007 Lee ..... 439/39
7,276,025 B2 * 10/2007 Roberts et al. ..... 600/249
7,339,790 B2 * 3/2008 Baker et al. ..... 361/709
7,362,018 B1 4/2008 Kulogo et al.
7,381,181 B2 6/2008 Lau et al.
7,402,175 B2 7/2008 Azar
7,438,726 B2 10/2008 Erb
7,444,683 B2 11/2008 Prendergast et al.
7,453,341 B1 11/2008 Hildenbrand
7,498,914 B2 3/2009 Miyashita et al.
7,583,500 B2 9/2009 Ligtenberg et al.
7,715,890 B2 5/2010 Kim et al.
7,775,567 B2 8/2010 Ligtenberg et al.
7,796,002 B2 9/2010 Hashimoto et al.
7,808,349 B2 10/2010 Fullerton et al.
7,812,697 B2 * 10/2010 Fullerton et al. ..... 335/306
7,817,004 B2 10/2010 Fullerton et al.
7,832,897 B2 * 11/2010 Ku ..... 362/249.02
7,837,032 B2 11/2010 Smeltzer
7,839,246 B2 11/2010 Fullerton et al.
7,843,297 B2 11/2010 Fullerton et al.
7,868,721 B2 1/2011 Fullerton et al.
7,874,856 B1 * 1/2011 Schriefer et al. ..... 439/214
7,889,037 B2 2/2011 Cho

(56) References Cited

U.S. PATENT DOCUMENTS

| | | | | |
|---|---|---|---|---|
| 7,903,397 | B2 * | 3/2011 | McCoy | 361/679.01 |
| 7,905,626 | B2 * | 3/2011 | Shantha et al. | 362/228 |
| 8,002,585 | B2 * | 8/2011 | Zhou | 439/642 |
| 8,099,964 | B2 | 1/2012 | Saito et al. | |
| 8,497,753 | B2 * | 7/2013 | DiFonzo et al. | 335/205 |
| 2002/0125977 | A1 | 9/2002 | VanZoest | |
| 2003/0170976 | A1 | 9/2003 | Molla et al. | |
| 2003/0179880 | A1 | 9/2003 | Pan et al. | |
| 2003/0187510 | A1 | 10/2003 | Hyde | |
| 2004/0003487 | A1 * | 1/2004 | Reiter | 24/303 |
| 2004/0155748 | A1 | 8/2004 | Steingroever | |
| 2004/0244636 | A1 | 12/2004 | Meadow et al. | |
| 2004/0251759 | A1 | 12/2004 | Hirzel | |
| 2005/0102802 | A1 | 5/2005 | Sitbon et al. | |
| 2005/0196484 | A1 | 9/2005 | Khoshnevis | |
| 2005/0231046 | A1 | 10/2005 | Aoshima | |
| 2005/0240263 | A1 | 10/2005 | Fogarty et al. | |
| 2005/0263549 | A1 | 12/2005 | Scheiner | |
| 2006/0066428 | A1 | 3/2006 | McCarthy et al. | |
| 2006/0189259 | A1 | 8/2006 | Park et al. | |
| 2006/0198047 | A1 | 9/2006 | Xue et al. | |
| 2006/0214756 | A1 | 9/2006 | Elliott et al. | |
| 2006/0290451 | A1 | 12/2006 | Prendergast et al. | |
| 2006/0293762 | A1 | 12/2006 | Schulman et al. | |
| 2007/0072476 | A1 * | 3/2007 | Milan | 439/373 |
| 2007/0075594 | A1 | 4/2007 | Sadler | |
| 2007/0103266 | A1 | 5/2007 | Wang et al. | |
| 2007/0138806 | A1 | 6/2007 | Ligtenberg et al. | |
| 2007/0255400 | A1 | 11/2007 | Parravicini et al. | |
| 2008/0119250 | A1 | 5/2008 | Cho et al. | |
| 2008/0139261 | A1 | 6/2008 | Cho et al. | |
| 2008/0174392 | A1 | 7/2008 | Cho | |
| 2008/0181804 | A1 | 7/2008 | Tanigawa et al. | |
| 2008/0186683 | A1 | 8/2008 | Ligtenberg et al. | |
| 2008/0218299 | A1 | 9/2008 | Arnold | |
| 2008/0224806 | A1 | 9/2008 | Ogden et al. | |
| 2008/0272868 | A1 | 11/2008 | Prendergast et al. | |
| 2008/0282517 | A1 | 11/2008 | Claro | |
| 2009/0021333 | A1 | 1/2009 | Fiedler | |
| 2009/0209173 | A1 | 8/2009 | Arledge et al. | |
| 2009/0250576 | A1 | 10/2009 | Fullerton et al. | |
| 2009/0251256 | A1 | 10/2009 | Fullerton et al. | |
| 2009/0254196 | A1 | 10/2009 | Cox et al. | |
| 2009/0278642 | A1 | 11/2009 | Fullerton et al. | |
| 2009/0289090 | A1 | 11/2009 | Fullerton et al. | |
| 2009/0289749 | A1 | 11/2009 | Fullerton et al. | |
| 2009/0292371 | A1 | 11/2009 | Fullerton et al. | |
| 2010/0033280 | A1 | 2/2010 | Bird et al. | |
| 2010/0126857 | A1 | 5/2010 | Polwart et al. | |
| 2010/0167576 | A1 * | 7/2010 | Zhou | 439/375 |
| 2011/0026203 | A1 | 2/2011 | Ligtenberg et al. | |
| 2011/0210636 | A1 | 9/2011 | Kuhlmann-Wilsdorf | |
| 2011/0234344 | A1 | 9/2011 | Fullerton et al. | |
| 2011/0248806 | A1 | 10/2011 | Michael | |
| 2011/0279206 | A1 | 11/2011 | Fullerton et al. | |
| 2012/0021619 | A1 * | 1/2012 | Bilbrey et al. | 439/39 |
| 2012/0028480 | A1 * | 2/2012 | Bilbrey et al. | 439/39 |
| 2012/0146513 | A1 * | 6/2012 | Radermacher | 315/119 |
| 2012/0244732 | A1 * | 9/2012 | Fullerton et al. | 439/236 |

FOREIGN PATENT DOCUMENTS

| | | | |
|---|---|---|---|
| EP | 0 345 554 | A1 | 12/1989 |
| EP | 0 545 737 | A1 | 6/1993 |
| FR | 823395 | | 1/1938 |
| GB | 1 495 677 | A | 12/1977 |
| JP | 60-091011 | U | 5/1985 |
| WO | WO-02/31945 | A2 | 4/2002 |
| WO | WO-2007/081830 | A2 | 7/2007 |
| WO | WO-2009/124030 | A1 | 10/2009 |
| WO | WO-2010/141324 | A1 | 12/2010 |

OTHER PUBLICATIONS

Atallah, K., Howe, D. 2001, "A Novel High-Performance Magnetic Gear", IEEE Transactions on Magnetics, vol. 37, No. 4, Jul. 2001, p. 2844-46.

Bassani, 2007, "Dynamic Stability of Passive Magnetic Bearings", Nonlinear Dynamics, V. 50, p. 161-68.

Boston Gear 221S-4, One-stage Helical Gearbox, http://www.bostongear.com/pdf/product_sections/200_series_helical.pdf, referenced Jun. 2010.

Charpentier et al., 2001, "Mechanical Behavior of Axially Magnetized Permanent-Magnet Gears", IEEE Transactions on Magnetics, vol. 37, No. 3, May 2001, p. 1110-17.

Chau et al., 2008, "Transient Analysis of Coaxial Magnetic Gears Using Finite Element Comodeling", Journal of Applied Physics, vol. 103.

Choi et al., 2010, "Optimization of Magnetization Directions in a 3-D Magnetic Structure", IEEE Transactions on Magnetics, vol. 46, No. 6, Jun. 2010, p. 1603-06.

Correlated Magnetics Research, 2009, Online Video, "Innovative Magnetics Research in Huntsville", http://www.youtube.com/watch?v=m4m81JjZCJo.

Correlated Magnetics Research, 2009, Online Video, "Non-Contact Attachment Utilizing Permanent Magnets", http://www.youtube.com/watch?v=3xUm25CNNgQ.

Correlated Magnetics Research, 2010, Company Website, http://www.correlatedmagnetics.com.

Furlani 1996, "Analysis and optimization of synchronous magnetic couplings", J. Appl. Phys., vol. 79, No. 8, p. 4692.

Furlani 2001, "Permanent Magnet and Electromechanical Devices", Academic Press, San Diego.

Furlani, E.P., 2000, "Analytical analysis of magnetically coupled multipole cylinders", J. Phys. D: Appl. Phys., vol. 33, No. 1, p. 28-33.

General Electric DP 2.7 Wind Turbine Gearbox, http://www.gedrivetrain.com/insideDP27.cfm, referenced Jun. 2010.

Ha et al., 2002, "Design and Characteristic Analysis of Non-Contact Magnet Gear for Conveyor by Using Permanent Magnet", Conf. Record of the 2002 IEEE Industry Applications Conference, p. 1922-27.

Huang et al., 2008, "Development of a Magnetic Planetary Gearbox", IEEE Transactions on Magnetics, vol. 44, No. 3, p. 403-12.

International Search Report and Written Opinion of the International Searching Authority issued in Application No. PCT/US12/61938 dated Feb. 26, 2013.

International Search Report and Written Opinion of the International Searching Authority issued in Application No. PCT/US2013/028095 dated May 13, 2013.

Jian et al., "Comparison of Coaxial Magnetic Gears With Different Topologies", IEEE Transactions on Magnetics, vol. 45, No. 10, Oct. 2009, p. 4526-29.

Jian, L., Chau, K.T., 2010, "A Coaxial Magnetic Gear With Halbach Permanent-Magnet Arrays", IEEE Transactions on Energy Conversion, vol. 25, No. 2, Jun. 2010, p. 319-28.

Jørgensen et al., "The Cycloid Permanent Magnetic Gear", IEEE Transactions on Industry Applications, vol. 44, No. 6, Nov./Dec. 2008, p. 1659-65.

Jørgensen et al., 2005, "Two dimensional model of a permanent magnet spur gear", Conf. Record of the 2005 IEEE Industry Applications Conference, p. 261-5.

Krasil'nikov et al., 2008, "Calculation of the Shear Force of Highly Coercive Permanent Magnets in Magnetic Systems With Consideration of Affiliation to a Certain Group Based on Residual Induction", Chemical and Petroleum Engineering, vol. 44, Nos. 7-8, p. 362-65.

Krasil'nikov et al., 2009, "Torque Determination for a Cylindrical Magnetic Clutch", Russian Engineering Research, vol. 29, No. 6, pp. 544-47.

Liu et al., 2009, "Design and Analysis of Interior-magnet Outer-rotor Concentric Magnetic Gears", Journal of Applied Physics, vol. 105.

Lorimer, W., Hartman, A., 1997, "Magnetization Pattern for Increased Coupling in Magnetic Clutches", IEEE Transactions on Magnetics, vol. 33, No. 5, Sep. 1997.

(56) References Cited

OTHER PUBLICATIONS

Mezani et al., 2006, "A high-performance axial-field magnetic gear", J. Applied Physics vol. 99.
Mi, "Magnetreater/Charger Model 580" Magnetic Instruments Inc. Product specification, May 4, 2009, http://web.archive.org/web/20090504064511/http://www.maginst.com/specifications/580_magnetreater.htm, 2 pages.
Neugart PLE-160, One-Stage Planetary Gearbox, http://www.neugartusa.com/ple_160_gb.pdf, referenced Jun. 2010.
Tsurumoto 1992, "Basic Analysis on Transmitted Force of Magnetic Gear Using Permanent Magnet", IEEE Translation Journal on Magnetics in Japan, Vo 7, No. 6, Jun. 1992, p. 447-52.
United States Office Action issued in U.S. Appl. No. 13/104,393 dated Apr. 4, 2013.
United States Office Action issued in U.S. Appl. No. 13/236,413 dated Jun. 6, 2013.
United States office Action issued in U.S. Appl. No. 13/246,584 dated May 16, 2013.
United States Office Action issued in U.S. Appl. No. 13/374,074 dated Feb. 21, 2013.
United States Office Action issued in U.S. Appl. No. 13/470,994 dated Jan. 7, 2013.
United States Office Action issued in U.S. Appl. No. 13/529,520 dated Sep. 28, 2012.
United States Office Action issued in U.S. Appl. No. 13/530,893 dated Mar. 22, 2013.
United States Office Action issued in U.S. Appl. No. 13/855,519 dated Jul. 17, 2013.
United States Office Action issued in U.S. Appl. No. 13/470,994 dated Aug. 8, 2013.
Series BNS, Compatible Series AES Safety Controllers, http://www.schmersalusa.com/safety_controllers/drawings/aes.pdf, pp. 159-175, date unknown.
BNS 33 Range, Magnetic safety sensors, Rectangular design, http://www.farnell.com/datasheets/36449.pdf, 3 pages, date unknown.
Series BNS-B20, Coded-Magnet Sensor Safety Door Handle, http://www.schmersalusa.com/catalog_pdfs/BNS_B20.pdf, 2 pages, date unknown.
Series BNS333, Coded-Magnet Sensors with Integral Safety Control Module, http://www.schmersalusa.com/machine_guarding/coded_magnet/drawings/bns333.pdf, 2 pages, date unknown.
Wikipedia, "Barker Code", Web article, last modified Aug. 2, 2008, 2 pages.
Wikipedia, "Kasami Code", Web article, last modified Jun. 11, 2008, 1 page.
Wikipedia, "Linear feedback shift register", Web article, last modified Nov. 11, 2008, 6 pages.
Wikipedia, "Golomb Ruler", Web article, last modified Nov. 4, 2008, 3 pages.
Wikipedia, "Costas Array", Web article, last modified Oct. 7, 2008, 4 pages.
Wikipedia, "Walsh Code", Web article, last modified Sep. 17, 2008, 2 pages.
Wikipedia, "Gold Code", Web article, last modified Jul. 27, 2008, 1 page.
Wikipedia, "Bitter Electromagnet", Web article, last modified Aug. 2011,1 page.
Pill-soo Kim, "A future cost trends of magnetizer systems in Korea", Industrial Electronics, Control, and Instrumentation, 1996, vol. 2, Aug. 5, 1996, pp. 991-996.
United States Office Action, dated Aug. 26, 2011, issued in counterpart U.S. Appl. No. 12/206,270.
United States Office Action, dated Mar. 12, 2012, issued in counterpart U.S. Appl. No. 12/206,270.
United States Office Action, dated Feb. 22, 2011, issued in counterpart U.S. Appl. No. 12/476,952.
United States Office Action, dated Oct. 12, 2011, issued in counterpart U.S. Appl. No. 12/476,952.
United States Office Action, dated Mar. 9, 2012, issued in counterpart U.S. Appl. No. 13/371,280.
International Search Report and Written Opinion, dated May 14, 2009, issued in related International Application No. PCT/US2009/038925.
International Search Report and Written Opinion, dated Jul. 13, 2010, issued in related International Application No. PCT/US2010/021612.
International Search Report and Written Opinion dated Jun. 1, 2009, issued in related International Application No. PCT/US2009/002027.
International Search Report and Written Opinion, dated Aug. 18, 2010, issued in related International Application No. PCT/US2010/036443.
International Search Report and Written Opinion, dated Apr. 8, 2011 issued in related International Application No. PCT/US2010/049410.

* cited by examiner

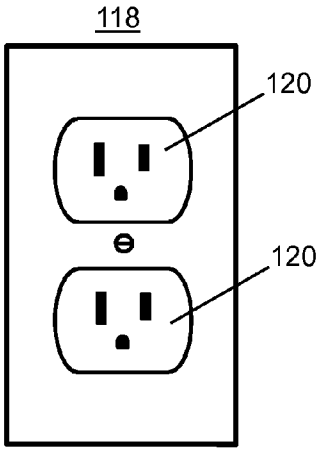
FIG. 1C *(Prior Art)*
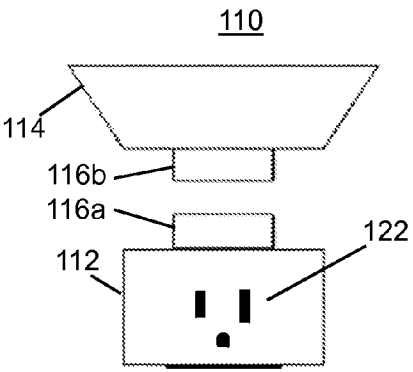
FIG. 1D (Front View)
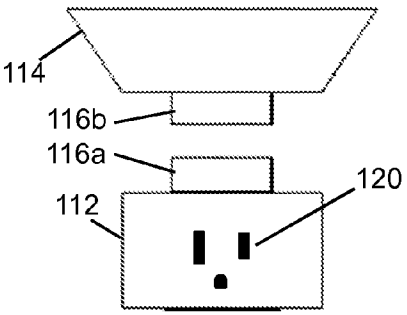
FIG. 1E (Back View)
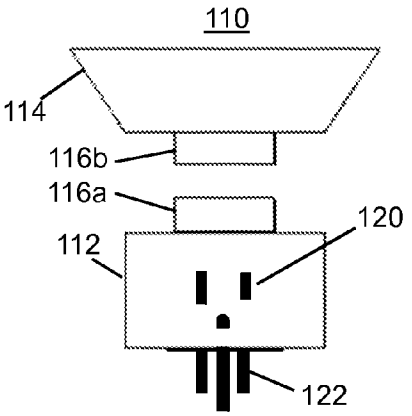
FIG. 1F (Front View)
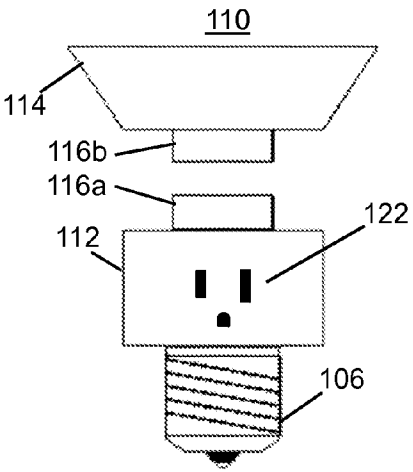
FIG. 1G (Front View)
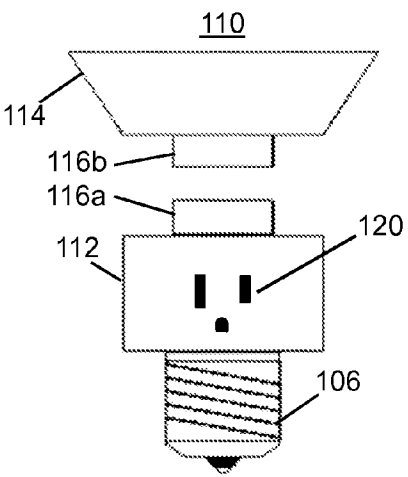
FIG. 1H (Back View)

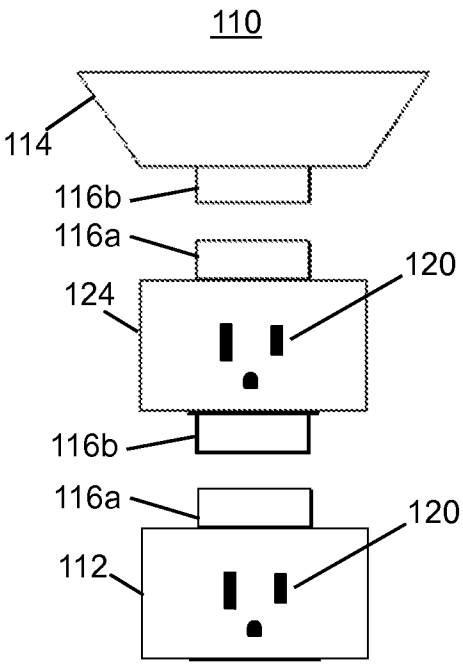
FIG. 1J (Back View)
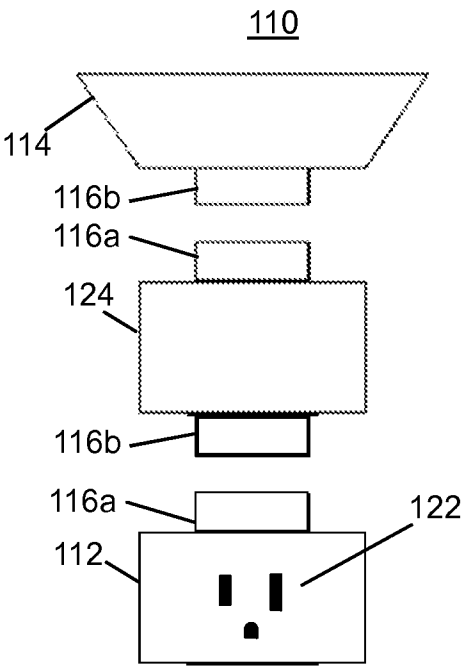
FIG. 1I (Front View)

ELECTRICAL ADAPTER SYSTEM

CROSS-REFERENCE TO RELATED APPLICATIONS

This patent application claims the priority benefit of U.S. Provisional Application No. 61,465,801 filed Mar. 24, 2011, which is incorporated herein by reference in its entirety.

FIELD OF THE INVENTION

The present invention relates generally to an electrical adapter system. More particularly, the present invention relates to an electrical adapter system including an electrical adapter for connecting to an electrical fixture.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

FIG. 1C depicts an exemplary electrical outlet;

FIG. 1D depicts a front view of an exemplary multi-part electrical system in accordance with the present invention;

FIG. 1E depicts a back view of the exemplary electrical adapter system of FIG. 1D;

FIG. 1F depicts a front view of another exemplary electrical adapter system in accordance with the present invention;

FIG. 1G depicts a front view of yet another exemplary electrical adapter system in accordance with the present invention;

FIG. 1H depicts a back view of the exemplary electrical adapter system of FIG. 1G;

FIG. 1I depicts a front view of still another exemplary electrical adapter system in accordance with the present invention that includes a stackable adapter;

FIG. 1J depicts a back view of the exemplary electrical adapter system of FIG. 1I;

DETAILED DESCRIPTION OF THE INVENTION

Figure 1B:
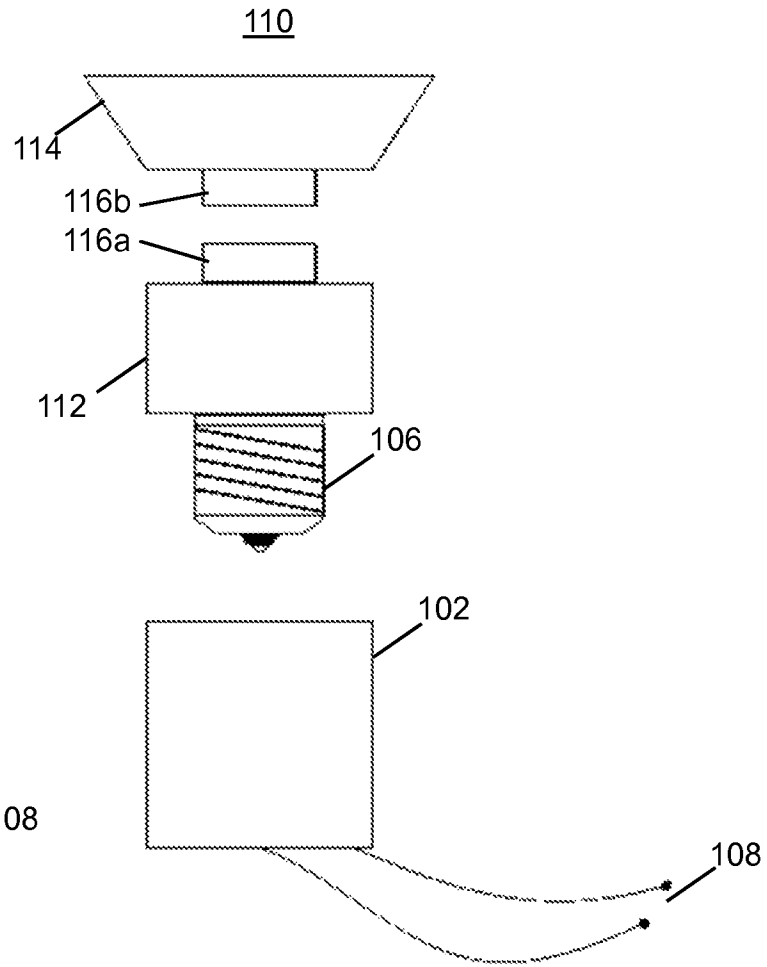
FIG. 1B depicts an exemplary electrical adapter system in accordance with the present invention comprising an electrical adapter and an exemplary electrical fixture.

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

The present invention provides an electrical adapter system. It involves magnetic techniques related to those described in U.S. Pat. No. 7,800,471, issued Sep. 21, 2010, U.S. patent application Ser. No. 12/358,423, filed Jan. 23, 2009, U.S. patent application Ser. No. 12/476,952, filed Jun. 2, 2009, and U.S. patent application Ser. No. 12/885,450, filed Sep. 18, 2010, which are all incorporated herein by reference in their entirety. The present invention may be applicable to systems and methods described in U.S. Pat. No. 7,681,256, issued Mar. 23, 2010, U.S. Pat. No. 7,750,781, issued Jul. 6, 2010, U.S. Pat. No. 7,755,462, issued Jul. 13, 2010, U.S. Pat. No. 7,812,698, issued Oct. 12, 2010, U.S. Pat. Nos. 7,817,002, 7,817,003, 7,817,004, 7,817,005, and 7,817,006, issued Oct. 19, 2010, U.S. Pat. No. 7,821,367, issued Oct. 26, 2010, U.S. Pat. Nos. 7,823,300 and 7,824,083, issued Nov. 2, 2010, U.S. Pat. No. 7,839,247, issued Nov. 23, 2010, and U.S. Pat. Nos. 7,843,295, 7,843,296, and 7,843,297, issued Nov. 30, 2010, and U.S. patent application Ser. No. 12/322,561, filed Feb. 4, 2009, U.S. patent application Ser. No. 12/479,821, filed Jun. 7, 2009, U.S. patent application Ser. No. 12/496,463, filed Jul. 1, 2009, U.S. patent application Ser. No. 12/499,039, filed Jul. 7, 2009, U.S. patent application Ser. No. 12/783,409, filed Jun. 19, 2010, U.S. patent application Ser. Nos. 12/894,937, 12/895,061, and 12/895,589, filed Sep. 30, 2010, and U.S. patent application Ser. Nos. 12/896,383, 12/896,424, 12/896,453, and 12/896,723, filed Oct. 1, 2010, which are all incorporated by reference herein in their entirety. The invention may also incorporate techniques described in U.S. Provisional Patent Application 61/403,814, filed Sep. 22, 2010, U.S. Provisional Patent Application 61/455,820, filed Oct. 27, 2010, U.S. Provisional Patent Application 61/459,329, filed Dec. 10, 2010, U.S. Provisional Patent Application 61/459,994, filed Dec. 22, 2010, U.S. Provisional Patent Application 61/461,570, filed Jan. 21, 2011, and U.S. Provisional Patent Application filed Feb. 7, 2011, titled "A System and Method for Producing Magnetic Structures", which are all incorporated by reference herein in their entirety.

In accordance with one embodiment of the invention, an electrical adapter system comprises an electrical adapter and an electrical fixture. The electrical adapter provides an electrical connection to an Edison screw socket. The electrical adapter includes an Edison screw base, a voltage converter circuit, and a first electrical connector part.

The Edison screw base is configured to receive a primary voltage from a voltage source. The adapter receives the primary voltage, for example 120 VAC, from an Edison screw light bulb socket and converts the primary voltage using the voltage converter circuit as required to supply a secondary, typically lower, and optionally variable voltage required by the electrical fixture.

Voltage converter circuit is configured to convert the primary voltage to the secondary voltage. The voltage converter circuit may be a switched mode power supply such as a buck converter.

The first electrical connector part is configured to be detachably coupled to a second electrical connector part of an electrical fixture configured to be powered by the secondary voltage. The first electrical connector part and second electrical connector part form a two part correlated magnetic electrical connector connecting the electrical adapter and electrical fixture.

Under one arrangement, the two parts of the correlated magnetic electrical connector to have a fixed position when magnetically aligned. For example, the two parts are fixed (i.e., unable to move) within the electrical adapter and electrical fixtures. In another arrangement, at least one of the two parts of the correlated magnetic electrical connector can move within a bounded area(s) within the electrical adapter and/or the electrical fixture. A moveable part of the correlated magnetic electrical connector may be located to a position and then held in that position by a lock, which may be some mechanical means such as a set screw. Generally, any of various well known mechanical means can to "lock" and "unlock" a connector in accordance with the invention.

In an exemplary embodiment, the electrical adapter comprises a driver circuit and the electrical fixture comprises a light emitting diode (LED) lamp, where the driver circuit can provide a variable secondary voltage enabling control over the LED lamp brightness and power consumption.

In another embodiment, an electrical fixture and/or an electrical adapter (or stackable adapter) may comprise one or more of an audio input device (e.g., a microphone), an audio output device (e.g., a speaker), a video input device (e.g., a movie camera), a video output device (e.g., a display), a radar (e.g., an ultra wideband radar), an environment sensor (e.g., a temperature, moisture, carbon dioxide, radon, smoke, or other sensor), a network communications device (e.g., a communications repeater device, a network router, or a communications portal), a security sensor (e.g., a motion sensor, infrared sensor, optical sensor, or other sensor), a light fixture (e.g., Christmas tree lights), a timer device, a remote control repeater device, or a rechargeable battery (e.g., to enable emergency lighting).

In a further embodiment, an electrical fixture and/or an electrical adapter (or stackable adapter) may function as part of a communication system, a person/object/animal tracking system, a security system, an environment control system, a environment monitoring system, a gaming system, an automation system, or a media (e.g., audio, video) delivery system. For example, an electrical adapter could include Blue Tooth or WiFi communications capabilities.

Under one arrangement, an electrical fixture and/or an electrical adapter (or stackable adapter) comprises at least one of a transponder, a transmitter, a receiver, or an antenna. Under another arrangement, an electrical adapter conveys communications signals via a wiring infrastructure to which an electrical outlet or an electrical fixture having an Edison screw light bulb socket is interfaced or otherwise connected. Under still another arrangement, an electrical adapter conveys tracking signals (e.g., time-domain reflectometry signals) via such a wiring infrastructure.

The magnetic sources employed in the invention may be permanent magnetic sources, electromagnets, electro-permanent magnets, or combinations thereof. Magnetic sources may be discrete magnets or may be printed into magnetizable material.

Figure 1A:
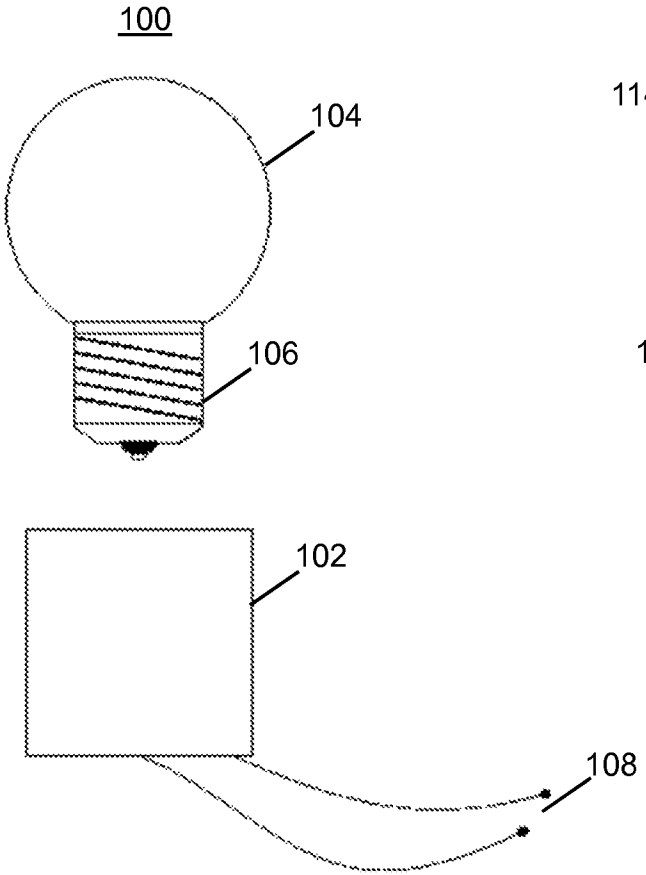
FIG. 1A (Prior Art)
FIG. 1A depicts an exemplary Edison screw light bulb socket and an exemplary Edison screw light bulb.

FIG. 1A depicts an exemplary Edison screw light bulb socket 102 and an exemplary Edison screw light bulb 100. The Edison screw light bulb 100 comprises a glass bulb portion 104 and an electrical male Edison screw base portion 106 that includes an electrical contact for receiving a voltage when placed (screwed) into the Edison screw light bulb socket 102. The electrical contact provides the voltage to a filament (not shown) inside the glass bulb portion 104 causing the light bulb 100 to produce light. The Edison screw light bulb socket 102 receives a voltage 108 from a primary voltage source, for example, a 120 VAC voltage source. One skilled in the art will recognize that all sorts of Edison screw light bulb sockets 102 exist for use in the United States and/or in other countries that receive different voltages (e.g., 240 VAC).

FIG. 1B depicts an exemplary electrical adapter system 110 in accordance with the present invention comprising an electrical adapter 112 and an exemplary electrical fixture 114. The electrical adapter 112 and electrical fixture 114 are connected physically and electrically using a first electrical connector part 116*a* and a second electrical connector part 116*b*. One skilled in the art will recognize that the electrical connection between the first and second electrical connector parts 116*a* 116*b* could be implemented using a plug and socket approach, an Edison screw socket approach, or any other electrical connector approach, whereby wiring, contacts, plugs, and sockets are not shown. Additionally, the shapes of the electrical adapter 112 and the electrical fixture 114 were arbitrarily chosen and can be shaped and sized as appropriate. Furthermore, although a single electrical fixture 114 is shown being attachable to an electrical adapter 112, two or more electrical fixtures 114 could be attachable to a single electrical adapter 112 having multiple first electrical connector parts 116*a* (not shown), where the driver circuitry of the electrical adapter could be configured to supply the same (or different) types of secondary voltage types as required to support the same (or different) voltage requirements of multiple electrical fixtures 114.

FIG. 1C depicts an exemplary electrical outlet 118 having two electrical sockets 120 for receiving electrical plugs (not shown) such as can be found on power cords for common electrical fixtures and electrical appliances including table lamps, televisions, computers, toasters, vacuum cleaners, and the like. One skilled in the art will recognize that the electrical outlet 118 could be a 120 VAC voltage source or any other voltage source available in the United States and/or in other countries (e.g., 240 VAC) and can conform to any of the many well known plug standards including Type A, Type B, Type C, Type D, Type E, Type F, Type E/F hybrid, Type G, Type H, Type I, Type J, Type K, Type L, Type M, or any other desired type.

FIG. 1D depicts a front view of an exemplary electrical adapter system 110 in accordance with the present invention. Instead of an Edison screw light bulb socket 102, the electrical adapter system 110 has a plug 122 able to connect into one of the electrical sockets 120 of the electrical outlet 118 of FIG. 1C.

FIG. 1E depicts a back view of the exemplary electrical adapter system 110 of FIG. 1D, which includes an optional electrical socket 120 enabling a person to connect the electrical adapter system 110 into an electrical socket 120 of an electrical outlet 118 while still providing an electrical socket 120 for receiving a plug such as a power cord for a vacuum cleaner. The electrical socket 120 outputs a voltage based on the primary voltage. For example, the electrical socket 120 may output a voltage with the same voltage as the primary voltage. The optional electrical socket 120 also enables two or more electrical adapter systems 110 to be daisy-chained to an electrical outlet 118. As such, multiple (perhaps different) electrical fixtures can be powered by a single electrical outlet 118.

FIG. 1F depicts a front view of another exemplary electrical adapter system 110 in accordance with the present invention, which is like the electrical adapter system 110 of FIGS. 1D and 1E except the plug 122 is on the bottom of the electrical adapter 112.

FIG. 1G depicts a front view of yet another exemplary electrical adapter system 110 in accordance with the present invention. As shown, the electrical adapter system 110 includes an electrical male Edison screw base portion 106 and an electrical plug 122 enabling the electrical adapter system 110 to be connected to either an Edison light bulb socket 102 or an electrical outlet 118.

FIG. 1H depicts a back view of the exemplary electrical adapter system 110 of FIG. 1G. As shown, the exemplary electrical adapter system 110 includes an optional electrical socket 120 enabling a plug of a device to be connected and/or enables daisy-chaining of multiple electrical adapter systems 110.

FIG. 1I depicts a front view of still another exemplary electrical adapter system 110 in accordance with the present invention that includes a stackable adapter 124. The first electrical connector part is configured to be detachably coupled to the stackable adapter 124. The stackable adapter 124 includes a third electrical connector part configured to be detachably coupled to the first electrical connector part of the electrical adapter and a fourth electrical connector part configured to be detachably coupled to the second electrical connector part of the electrical fixture. The third electrical connector part of the stackable adapter 124 may be identical to the second electrical connector part of the electrical fixture 114. The fourth electrical connector part of the stackable adapter 124 may be identical to the first electrical connector part of the electrical adapter 112.

The stackable adapter 124 is configured to reside between an electrical adapter 112 configured with an electrical plug 122 for connection into an electrical outlet. Alternatively, a stackable adapter 124 can be configured to reside between an electrical adapter 112 configured with an electrical male Edison screw base portion 106 enabling the electrical adapter system 110 to be connected to either an Edison light bulb socket 102. As described in relation to FIGS. 1G and 1H the stackable adapter 124 could be configured to reside between an electrical adapter configured to connect to an electrical outlet 118 or to an Edison light bulb socket 102. Moreover, multiple stackable adapters 120 can be placed between an electrical adapter 112 and an electrical fixture 114.

FIG. 1J depicts a back view of the exemplary electrical adapter system 110 of FIG. 1I having a stackable electrical adapter 124, where both adapters 112 124 include an optional electrical socket 120. One skilled in the art will recognize that all sorts of combinations of electrical adapters 112, stackable adapters 124, and electrical fixtures 114 are possible as configured using various combinations of electrical sockets 120, electrical plugs 122, and electrical male Edison screw base portions 106.

Figure 2A:
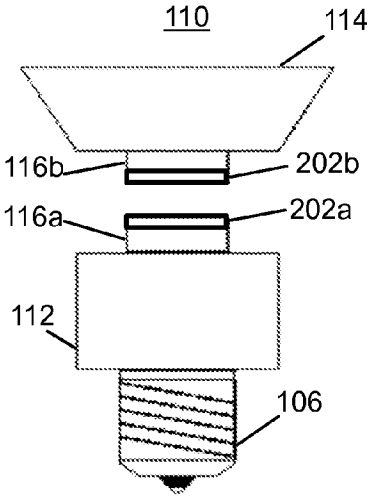
FIG. 2A depicts two exemplary components of a correlated magnetic electrical connector used to magnetically attach and electrically connect the electrical adapter and electrical fixture of an electrical adapter system in accordance with the present invention.

FIG. 2A depicts two exemplary components 202*a* 202*b* of a correlated magnetic electrical connector used to magnetically attach and electrically connect the electrical adapter 112 and electrical fixture 114 of an electrical adapter system 110 in accordance with the present invention. As shown in FIG. 2A, the first electrical connector part 116*a* comprises a first correlated magnetic electrical connector component 202*a* and the second electrical connector part 116*b* comprises a second correlated magnetic electrical connector component 202*b*. As such, the first and second electrical connector parts 116*a* 116*b* serve as housings for and include electrical wiring/circuitry connecting to the respective first and second correlated magnetic electrical connector components 202*a* 202*b*. The first and second correlated magnetic electrical connector components 202*a* 202*b* are configured at or near the surface of the first and second electrical connector parts 116*a* 116*b* enabling them to be magnetically attached by aligning the first and second correlated magnetic electrical connector components 202*a* 202*b* using sideways translational movement. Once the first and second correlated magnetics connector components 202*a* 202*b* are magnetically attached, the electrical adapter 112 and the electrical fixture 114 of the electrical adapter system 110 are electrically connected.

Figure 2B:
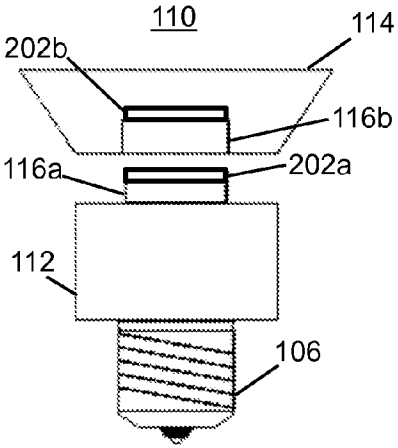
FIG. 2B depicts another two exemplary parts of a correlated magnetic electrical connector used to attach the parts of a electrical adapter system in accordance with the present invention.

FIG. 2B depicts another two exemplary components 202*a* 202*b* of a correlated magnetic electrical connector used to magnetically attach and electrically connect the electrical adapter 112 and electrical fixture 114 of an electrical adapter system 110 in accordance with the present invention. As shown in FIG. 2B, the second electrical connector part 116*b* and second correlated magnetic electrical connector 202*b* are recessed into the electrical fixture 114 to serve as a female portion of a male-female connector, whereby the first electrical connector part 116*a* and first correlated magnetic electrical connector 202*a* serve as the male portion of the male-female connector. Electrical wiring attached to the second correlated magnetic electrical connector 202*b* could reside in the electrical fixture 114 and could reside in the second electrical connector part 116*b* or the second electrical connector part 116*b* could merely act as a housing in which the second correlated magnetic electrical connector 202*b* resides and within which the first electrical connector part 116*a* and first correlated magnetic electrical connector 202*a* are inserted. One skilled in the art will recognized that the male-female connector approach prevents the use of sideways translational movement and instead requires up and down translational movement and (optionally) rotational movement.

Figure 2C:
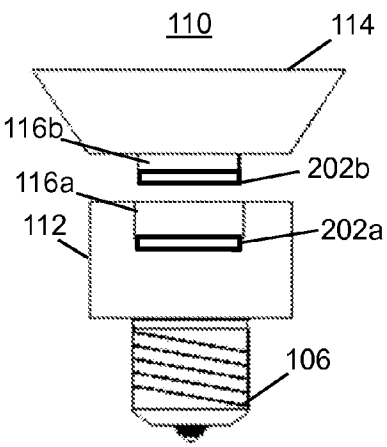
FIG. 2C depicts yet another two exemplary components of a correlated magnetic electrical connector used to attach the parts of a electrical adapter system in accordance with the present invention.

FIG. 2C depicts yet another two exemplary components 202*a* 202*b* of a correlated magnetic electrical connector used to attach the electrical adapter 112 and electrical fixture 114 of an electrical adapter system 110 in accordance with the present invention. As shown in FIG. 2C, the first electrical connector part 116*a* and second correlated magnetic electrical connector 202*a* are recessed into the electrical adapter 112 to serve as a female portion of a male-female connector, whereby the second electrical connector part 116*b* and second correlated magnetic electrical connector 202*b* serve as the male portion of the male-female connector. Electrical wiring attached to the first correlated magnetic electrical connector 202*a* could reside in the electrical adapter 112 and could reside in the first electrical connector part 116*a* or the first electrical connector part 116*a* could merely act as a housing in which the first correlated magnetic electrical connector 202*a* resides and within which the second electrical connector part 116*b* and second correlated magnetic electrical connector 202*b* are inserted.

Figure 2D:
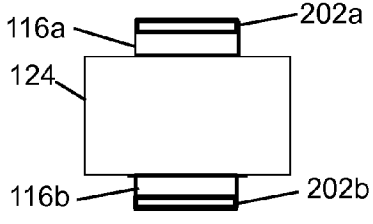
FIG. 2D depicts an exemplary stackable adapter that can be used with the two exemplary components of the correlated magnetic electrical connector of FIG. 2A.

FIG. 2D depicts an exemplary stackable adapter 124 that can be used with the two exemplary components 202*a* 202*b* of the correlated magnetic electrical connector of FIG. 2A. As shown in FIG. 2D, the first component 202*a* of the correlated magnetic electrical connector of the exemplary stackable adapter 124 can connect to the second component 202*b* of the correlated magnetic electrical connector associated with the electrical fixture 114 of the electrical adapter systems 110 of FIGS. 2A-2C. Similarly, the second component 202*b* of the correlated magnetic electrical connector of the exemplary adapter 124 can connect to the first component 202*a* of the correlated magnetic electrical connector of the electrical adapter 112 of the electrical adapter systems 110 of FIGS. 2A-2C. Moreover, multiple stackable adapters 124 can be daisy-chained between an electrical fixture 114 and electrical adapter 112 of an electrical adapter system 110 in accordance with the present invention, whereby the first component 202*a* of the correlated magnetic electrical connector of the a first stackable adapter 124 will connect to the second component 202*b* of the correlated magnetic electrical connector of the second stackable adapter 124, and so on.

Figure 2E:
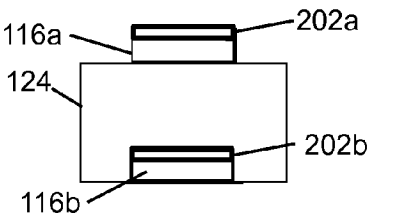
FIG. 2E depicts an exemplary stackable adapter that can be used with the two exemplary components of the correlated magnetic electrical connector of FIG. 2B.

FIG. 2E depicts an exemplary stackable adapter 124 that can be used with the two exemplary components 202*a* 202*b* of the correlated magnetic electrical connector of FIG. 2B. In a manner similar to what has been described in relation to FIG. 2D, one or more stackable adapters 124 such as depicted in FIG. 2E can reside between the electrical adapter 112 and electrical fixture 114 of the electrical adapter systems 110 of FIG. 2A or 2B.

Figure 2F:
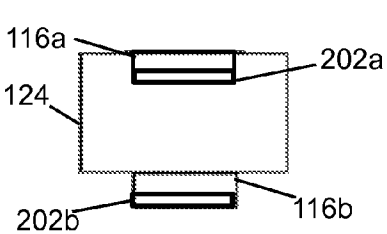
FIG. 2F depicts an exemplary stackable adapter that can be used with the two exemplary components of the correlated magnetic electrical connector of FIG. 2C.

FIG. 2F depicts an exemplary stackable adapter 124 that can be used with the two exemplary components 202*a* 202*b* of the correlated magnetic electrical connector of FIG. 2C. In a manner similar to what has been described in relation to FIG. 2D, one or more stackable adapters 124 such as depicted in FIG. 2F can reside between the electrical adapter 112 and electrical fixture 114 of the electrical adapter systems 110 of FIG. 2A or 2C. An alternative stackable adapter 124 (not shown) could have exemplary components 202*a* 202*b* of a correlated magnetic electrical connector that both function as female portions of a male-female connector that could be used with the electrical adapter system 110 of FIG. 2A.

Figure 3A:
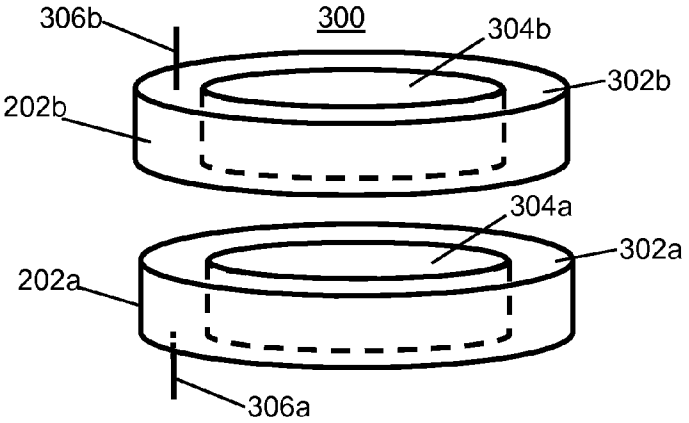
FIG. 3A depicts exemplary ring-shaped electrical contact portions and exemplary circularly-shaped correlated magnetic structure portions of two exemplary components of a correlated magnetic electrical connector in accordance with the present invention.

FIG. 3A depicts exemplary ring-shaped electrical contact portions 302*a* 302*b* and exemplary circularly-shaped correlated magnetic structure portions 304*a* 304*b* of two exemplary components 202*a* 202*b* of a correlated magnetic electrical connector 300 in accordance with the present invention. As shown, electrical cables 306*a* 306*b* are connected to the ring-shaped electrical contact portions 302*a* 302*b*, respectively.

Figure 3B:
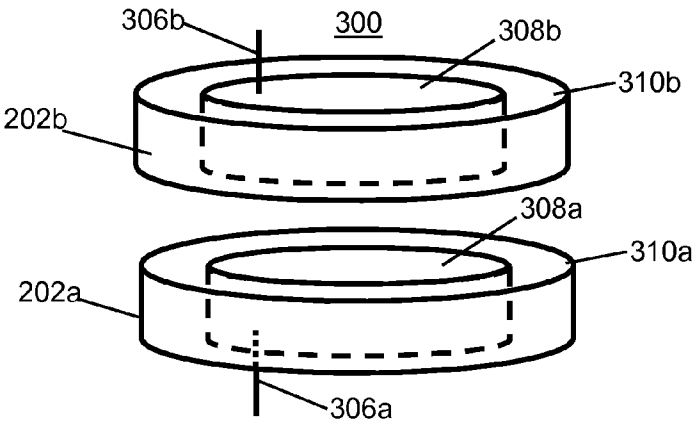
FIG. 3B depicts exemplary circularly-shaped electrical contact portions and exemplary ring-shaped correlated magnetic structure portions of two exemplary components of a correlated magnetic electrical connector in accordance with the present invention.

FIG. 3B depicts exemplary circularly-shaped electrical contact portions 308*a* 308*b* and exemplary ring-shaped correlated magnetic structure portions 310*a* 310*b* of two exemplary components 202*a* 202*b* of a correlated magnetic electrical connector 300 in accordance with the present invention. As shown, electrical cables 306*a* 306*b* are connected to the circularly-shaped electrical contact portions 308*a* 308*b*, respectively.

Figure 3C:
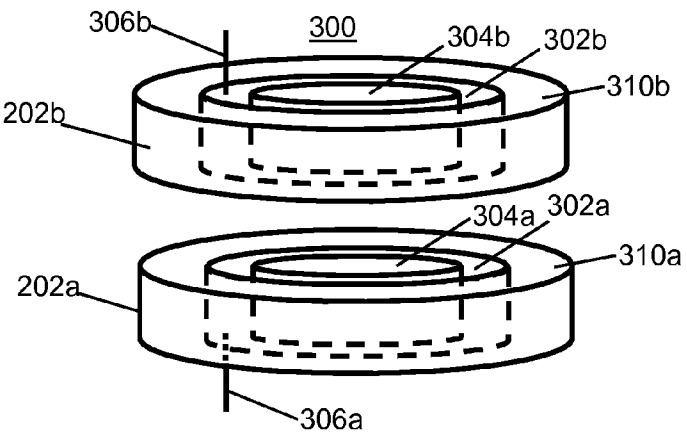
FIG. 3C depicts exemplary ring-shaped electrical contact portions and exemplary circularly-shaped and ring-shaped correlated magnetic structure portions of two exemplary components of a correlated magnetic electrical connector in accordance with the present invention.

FIG. 3C depicts exemplary ring-shaped electrical contact portions 302*a* 302*b* and exemplary circularly-shaped 304*a* 304*b* and ring-shaped 310*a* 310*b* correlated magnetic structure portions of two exemplary components 202*a* 202*b* of a correlated magnetic electrical connector 300 in accordance with the present invention. As shown, electrical cables 306*a* 306*b* are connected to the ring-shaped electrical contact portions 302*a* 302*b*, respectively.

Figure 3D:
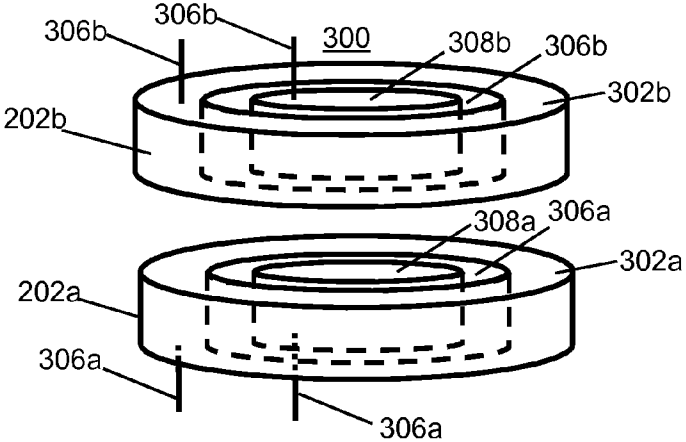
FIG. 3D depicts exemplary ring-shaped and circularly-shaped electrical contact portions and exemplary ring-shaped correlated magnetic structure portions of two exemplary components of a correlated magnetic electrical connector in accordance with the present invention.

FIG. 3D depicts exemplary ring-shaped electrical contact portions 306*a* 306*b* and circularly-shaped electrical contact portions 302*a* 302*b* and exemplary ring-shaped correlated magnetic structure portions 306*a* 306*b* of two exemplary components 202*a* 202*b* of a correlated magnetic electrical connector 300 in accordance with the present invention. As shown, electrical cables 306*a* 306*b* are connected to the ring-shaped electrical contact portions 302*a* 302*b*, respectively, and to the circularly-shaped electrical contact portions 308*a* 308*b*, respectively.

Figure 4A:
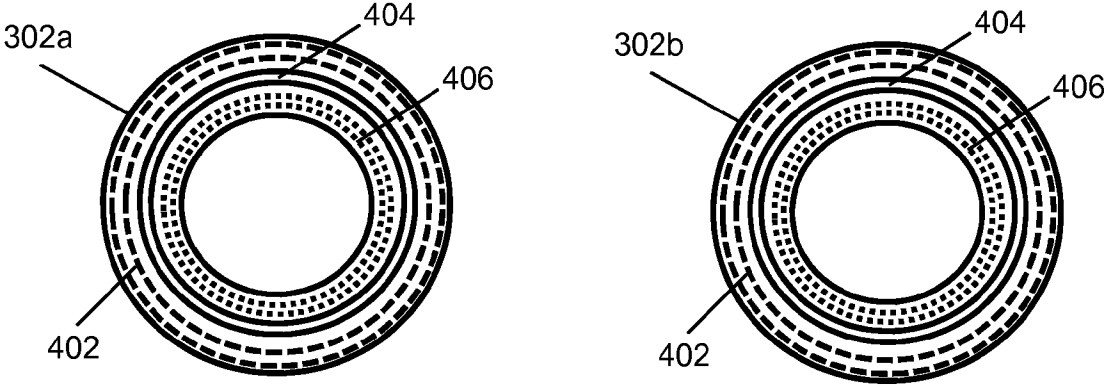
FIG. 4A depicts exemplary electrical contacts of exemplary ring-shaped electrical portions of two exemplary components of a correlated magnetic electrical connector in accordance with the present invention.

FIG. 4A depicts exemplary electrical contacts 402 404 406 of exemplary ring-shaped electrical portions of two exemplary components 302*a* 302*b* of a correlated magnetic electrical connector 300 in accordance with the present invention. As shown in FIG. 4A, outermost ring-shaped electrical portions 402 indicated by two dashed circular lines surround middle ring-shaped electrical portions 404 indicated by two solid circular lines that surround the innermost ring-shaped electrical portions 406 indicated by two dotted circular lines. As such, when the two components 302*a* 302*b* are aligned and in contact, there corresponding electrical contact portions 402 404 406 become in contact providing three separate electrical connections, which could be used for example for power, ground, and communications. Generally, to practice the invention, at least two electrical contact portions are required to provide power and ground connectivity but one or more additional electrical contact portions can also be used for other purposes (e.g., for communications, to provide a control signal, or to provide a data signal). Communications connectivity may be used, for example, to identify to an electrical adapter the type of electrical fixture that has been connected to it (or vice versa), to provide sensor information, to provide control signals, etc. Alternatively, two or more electrical contact portions could be used to provide two or more different types of electrical power (e.g., different voltages).

Figure 4B:
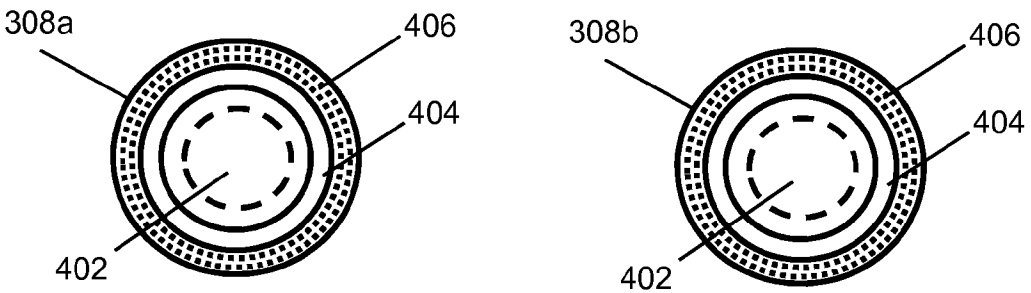
FIG. 4B depicts exemplary electrical contacts of exemplary circularly-shaped electrical portions of two exemplary components of a correlated magnetic electrical connector in accordance with the present invention.

FIG. 4B depicts exemplary electrical contacts of exemplary circularly-shaped electrical portions of two exemplary components of a correlated magnetic electrical connector in accordance with the present invention. As with the electrical contacts of FIG. 4A, three different contact portions 402 404 406 are shown, which might correspond (in no particular order) to communications, power, and ground. As described in relation to FIG. 4A, all sorts of combinations are possible including multiple power connections for supplying different voltages, and so forth.

Figure 5A:
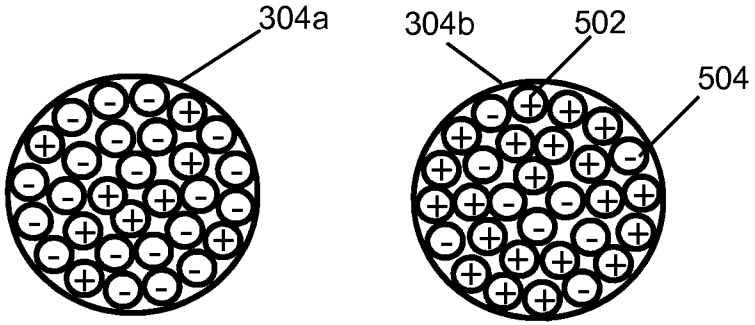
FIG. 5A depicts exemplary circularly-shaped complementary correlated magnetic structure portions of two exemplary components of a correlated magnetic electrical connector in accordance with the present invention.

FIG. 5A depicts exemplary circularly-shaped complementary correlated magnetic structure portions 304*a* 304*b* of two exemplary components of a correlated magnetic electrical connector 300 in accordance with the present invention. As shown in FIG. 5A, the correlated magnetic structure portions 304*a* 304*b* have complementary (i.e., mirror image) patterns of positive maxels 502 and negative maxels 504. The specific patterns used for the magnetic structure portions 304*a* 304*b* of a correlated magnetic electrical connector 300 can be selected to have only one rotational alignment where the maxels will all correlate. Alternatively, they may be coded to allow several different correlated positions (e.g., every 60 degrees). The coding pattern used in FIG. 5A comprises three concentric circles of maxels with the outer circle corresponding to four Barker 4 code modulos, the middle circle corresponding to two Barker 5 code modulos, and the innermost circle corresponding to a complementary Barker 4 code modulo.

Figure 5B:
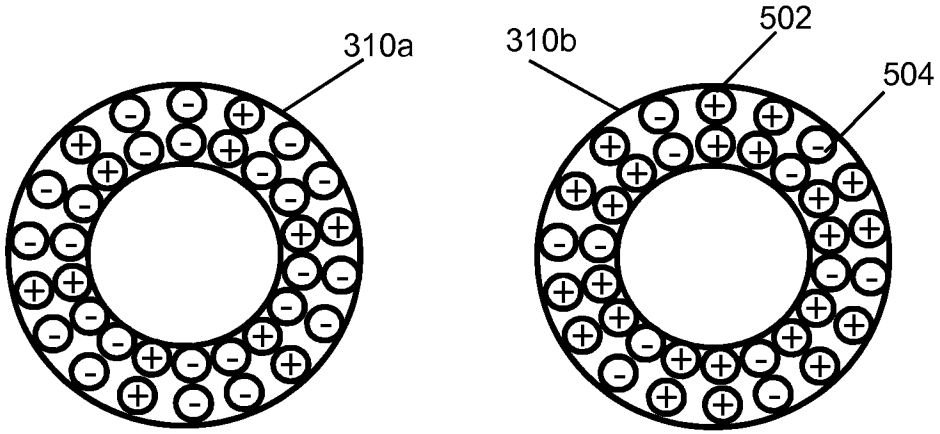
FIG. 5B depicts exemplary ring-shaped complementary correlated magnetic structure portions of two exemplary components of a correlated magnetic electrical connector in accordance with the present invention.

FIG. 5B depicts exemplary ring-shaped complementary correlated magnetic structure portions 310*a* 310*b* of two exemplary components of a correlated magnetic electrical connector 300 in accordance with the present invention. As shown in FIG. 5B, the correlated magnetic structure portions 310*a* 310*b* have complementary (i.e., mirror image) patterns of positive maxels 502 and negative maxels 504. As with the correlated magnetic portions 304*a* 304*b* of FIG. 5A, the specific patterns used for the magnetic structure portions 310*a* 310*b* of a correlated magnetic electrical connector 300 of FIG. 5B can be selected to have only one rotational alignment where the maxels will all correlate or they may be coded to allow several different fully or partially correlated positions. The coding may cause certain rotational alignments where a repel force is produced. Generally, all sorts of magnetic behaviors can be prescribed using correlated magnetics coding techniques. The coding pattern used in FIG. 5B comprises two concentric circles of maxels oriented in a radial pattern, where the two concentric circles each correspond to six code modulos of a Barker 3 code.

Figure 5C:
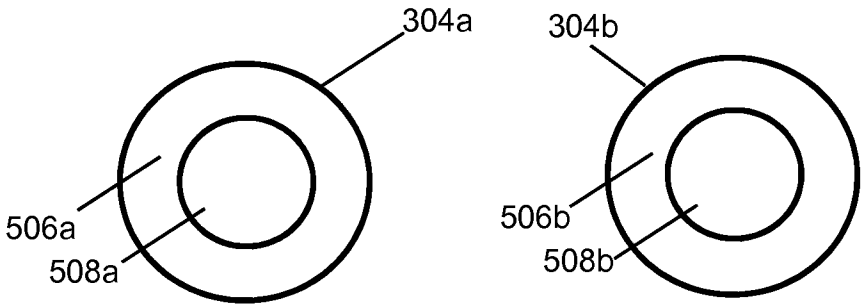
FIG. 5C depicts another exemplary circularly-shaped multi-level correlated magnetic structure portions of two exemplary components of a correlated magnetic electrical connector in accordance with the present invention.
Figure 5D:
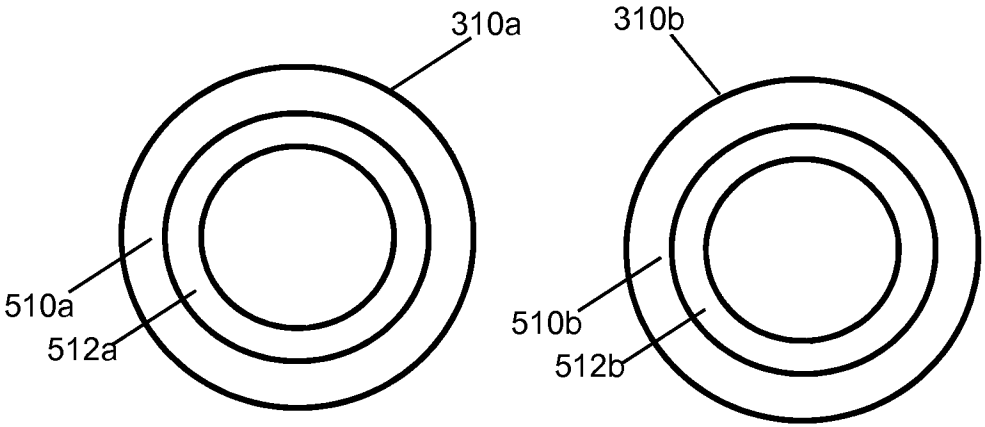
FIG. 5D depicts exemplary ring-shaped multi-level correlated magnetic structure portions of two exemplary components of a correlated magnetic electrical connector in accordance with the present invention.

FIGS. 5C and 5D are representative of the use of multi-level correlated magnetic structures as the correlated magnetic structure portions of a correlated magnetic electrical connector. Multi-level correlated magnetic structures are described in U.S. patent application Ser. No. 12/885,450, filed Sep. 18, 2010, which is incorporated herein by reference. Generally, such multi-level correlated structures have first and second regions the produce different force vs. distance characteristics that combine to cause magnetic forces that transition from an attract state to a repel state depending on the distance the structures are separated.

FIG. 5C depicts exemplary circularly-shaped multi-level correlated magnetic structure portions 304*a* 304*b* of two exemplary components of a correlated magnetic electrical connector 300 in accordance with the present invention. As shown, the first circularly-shaped multi-level correlated magnetic structure portion 304*a* comprises a first region 506*a* and a second region 508*a* and the second circularly-shaped multi-level correlated magnetic structure portion 304*b* also comprises a first region 506*b* and a second region 508*b* that interact with the two regions 506*a* 508*a* of the first circularly-shaped multi-level correlated magnetic structure portion 304*a* to produce multi-level magnetism. As shown, the two first regions 506*a* 506*b* are ring-shaped and the second regions 508*a* 508*b* are circularly-shaped. Many other shapes of two or more regions could also be employed to produce multi-level magnetism.

FIG. 5D depicts exemplary ring-shaped multi-level correlated magnetic structure portions of two exemplary components of a correlated magnetic electrical connector in accordance with the present invention. As shown, the first ring-shaped multi-level correlated magnetic structure portion 310*a* comprises a first region 510*a* and a second region 512*a* and the second ring-shaped multi-level correlated magnetic structure portion 310*b* also comprises a first region 510*b* and a second region 512*b* that interact with the two regions 510*a* 512*a* of the first ring-shaped multi-level correlated magnetic structure portion 310*a* to produce multi-level magnetism. As shown, the two first regions 510*a* 512*b* are ring-shaped and the second regions 510*a* 512*b* are ring-shaped. Many other shapes of two or more regions could also be employed to produce multi-level magnetism.

Although, the exemplary connectors and associated magnetic structures have been described herein as being circularly-shaped and ring-shaped, one skilled in the art will recognize that other shapes including square, rectangular, or any other desired shape could be employed in accordance with the invention.

While particular embodiments of the invention have been described, it will be understood, however, that the invention is not limited thereto, since modifications may be made by those skilled in the art, particularly in light of the foregoing teachings.

The invention claimed is:

1. An electrical adapter system, comprising:

an electrical adapter, comprising:

an Edison screw base configured to receive a primary voltage from a voltage source;

a voltage converter circuit configured to convert the primary voltage to a secondary voltage; and one of a first electrical connector part configured to be detachably coupled to one of a second electrical connector part of an electrical fixture configured to be powered by the secondary voltage; and at least one stackable electrical adapter configured to be placed between said electrical adapter and said electrical fixture, each said stackable electrical adapter of said at least one stackable electrical adapter having one of said first electrical connector part that is located on a first side and having one of said second electrical connector part that is located on a second side that is opposite said first side, each said first electrical connector part and each said second electrical connector part comprising:

a first contact portion for providing said secondary voltage;

a second contact portion for providing a ground; and a third contact portion for providing a data signal, said first, second, and third contact portions of each said first electrical connector part being configured to provide an electrical connection with said first, second, and third contact portions of each said second electrical connector part enabling daisy-chaining of multiple stackable electrical adapters between said electrical adapter and said electrical fixture.

2. The electrical adapter system of claim 1, wherein the primary voltage is greater than the secondary voltage.

3. The electrical adapter system of claim 1, wherein at least one of the first electrical connector part or the second electrical connector part serves as a male portion, and the other electrical connector part serves as a female portion.

4. The electrical adapter system of claim 1, wherein the primary voltage is applied to the electrical adapter when the Edison screw base is screwed into an Edison screw socket.

5. The electrical adapter system of claim 1, wherein said electrical adapter further comprises an electrical socket that outputs a voltage based on the primary voltage.

6. The electrical adapter system of claim 1, wherein said first electrical connector part comprises a first magnetic structure having a plurality of emission sources with polarities positioned according to a first pattern and the second electrical connector part comprises a second magnetic structure having a plurality of emissions sources with polarities positioned according to a second pattern, wherein the second pattern has a complementary correlation to the first pattern.

7. The electrical adapter system of claim 6, wherein the first magnetic structure and the second magnetic structure are configured to have a fixed position when magnetically aligned.

8. The electrical adapter system of claim 7, wherein the first magnetic structure and the second magnetic structure are configured to be movable within a bounded area when magnetically aligned.

9. The electrical adapter system of claim 8, wherein the first electrical connector part comprises a mechanical lock configured to lock and unlock the second electrical connector part in place relative to the first electrical connector part.

10. The electrical adapter system of claim 6, wherein the first magnetic structure comprises a first coding pattern and the second magnetic structure comprises a second coding pattern having one or more fully or partially correlated positions with the first coding pattern.

11. The electrical adapter system of claim 6, wherein the first magnetic structure and the second magnetic structure comprise multi-level correlated magnetic structures.

12. The electrical adapter system of claim 1, wherein said electrical fixture comprises a light emitting diode lamp, wherein the voltage converter circuit enables variation of the secondary voltage to control brightness and power consumption of the light emitting diode lamp.

13. An electrical system, comprising:

an electrical adapter comprising:

an Edison screw base configured to receive a primary voltage from a voltage source; and a voltage converter circuit configured to convert the primary voltage to the secondary voltage; and a first stackable electrical adapter configured to be powered by the secondary voltage, said first stackable electrical adapter having a first side and a second side opposite said first side, wherein the electrical adapter is configured to be electrically connected to the first side of the first stackable electrical adapter or to an electrical fixture using a two part electrical connector to provide said secondary voltage, a ground, and a data signal, said electrical fixture being configured to be powered by the secondary voltage, wherein the second side of the first stackable electrical adapter is configured to be electrically connected to the electrical fixture or to be daisy-chained to a second stackable electrical adapter using said two part electrical connector to provide said secondary voltage, a ground, and a data signal, said electrical fixture being configured to be powered by the secondary voltage, said second stackable electrical adapter being configured to be electrically connected to said electrical adapter and said electrical fixture and to be daisy-chained to said first stackable electrical adapter using said two part electrical connector to provide said secondary voltage, a ground, and a data signal.

14. The electrical system of claim 13, wherein the two part electrical connector comprises a first electrical connector part and a second electrical connector part, wherein the electrical adapter further comprises the first electrical connector part and the electrical fixture comprises the second electrical connector part, wherein the first stackable electrical adapter comprises the first electrical connector part and the second electrical connector part.

15. The electrical adapter of claim 13, wherein said first electrical connector part comprises a first magnetic structure having a plurality of emission sources with polarities positioned according to a first pattern and the second electrical connector part comprises a second magnetic structure having a plurality of emissions sources with polarities positioned according to a second pattern, wherein the second pattern has a complementary correlation to the first pattern.

16. The electrical adapter of claim 15, wherein the first magnetic structure and the second magnetic structure are configured to have a fixed position when magnetically aligned.

17. The electrical adapter of claim 15, wherein the first magnetic structure and the second magnetic structure are configured to be movable within a bounded area when magnetically aligned.

18. The electrical adapter of claim 17, wherein the first electrical connector part comprises a mechanical lock configured to lock and unlock the second electrical connector part in place relative to the first electrical connector part.

19. The electrical adapter of claim 15, wherein the first magnetic structure comprises a first coding pattern and the second magnetic structure comprises a second coding pattern having one or more fully or partially correlated positions with the first coding pattern.

20. The electrical adapter of claim 15, wherein the first magnetic structure and the second magnetic structure comprise multi-level correlated magnetic structures.

* * * * *